US008240489B2

(12) United States Patent
McCormack

(10) Patent No.: US 8,240,489 B2
(45) Date of Patent: Aug. 14, 2012

(54) TRAVERSE ROD ASSEMBLY

(75) Inventor: Randy McCormack, Lilburn, GA (US)

(73) Assignee: Selective Enterprises, Inc., Charlotte, NC (US)

( * ) Notice: Subject to any disclaimer, the term of this patent is extended or adjusted under 35 U.S.C. 154(b) by 0 days.

(21) Appl. No.: 12/885,057

(22) Filed: Sep. 17, 2010

(65) Prior Publication Data

US 2011/0062099 A1 Mar. 17, 2011

Related U.S. Application Data

(60) Provisional application No. 61/243,412, filed on Sep. 17, 2009.

(51) Int. Cl.
*A47H 1/00* (2006.01)

(52) U.S. Cl. ..... 211/123; 16/87.4 R; 16/93 D

(58) Field of Classification Search ..... 211/105.1, 211/123, 124; 160/345; 16/87.2, 87.4 R, 16/93 D, 93 R
See application file for complete search history.

(56) References Cited

U.S. PATENT DOCUMENTS

| | | | | |
|---|---|---|---|---|
| 592,795 | A | 11/1897 | Leslie | |
| 3,119,442 | A | 1/1964 | Ford et al. | |
| 3,178,760 | A * | 4/1965 | Kalal et al. | 16/87.6 R |
| 3,192,994 | A | 7/1965 | Graber et al. | |
| 3,324,501 | A | 6/1967 | Lydard | |
| 3,344,463 | A | 10/1967 | Znamirowski | |
| 3,370,819 | A | 2/1968 | Kenney | |
| 3,419,065 | A | 12/1968 | Johnson | |
| 3,430,678 | A | 3/1969 | Steck et al. | |
| 3,521,318 | A | 7/1970 | Johnson | |
| 3,616,486 | A * | 11/1971 | Ford et al. | 16/87.2 |
| 3,665,550 | A * | 5/1972 | MacFarlane et al. | 16/93 D |
| 3,703,740 | A * | 11/1972 | Mann et al. | 16/87.2 |
| 3,766,597 | A | 10/1973 | Ford et al. | |
| 3,881,218 | A * | 5/1975 | Palmer | 16/93 D |
| 3,991,435 | A | 11/1976 | Ford | |
| 3,992,749 | A | 11/1976 | Getchell | |
| 4,123,820 | A * | 11/1978 | Hamilton | 16/95 D |
| 4,141,105 | A | 2/1979 | Gonon | |
| 4,178,656 | A | 12/1979 | MacFarlane | |
| 4,190,927 | A | 3/1980 | Hepperle | |
| 4,381,029 | A | 4/1983 | Ford et al. | |
| 4,390,055 | A | 6/1983 | Fenley | |
| 4,402,109 | A | 9/1983 | Ohman et al. | |
| 4,584,737 | A | 4/1986 | Ohman | |
| 4,827,565 | A | 5/1989 | Froutzis | |
| 5,518,058 | A | 5/1996 | Gastmann | |
| 5,611,111 | A | 3/1997 | Bosgoed | |
| 5,765,260 | A | 6/1998 | Judkins | |
| 6,085,826 | A | 7/2000 | Maesaki | |
| 6,125,909 | A | 10/2000 | Walker et al. | |
| 6,223,389 | B1 | 5/2001 | Walsh et al. | |
| 6,499,708 | B1 | 12/2002 | Cowen | |
| 6,719,158 | B2 * | 4/2004 | Goldberg | 211/123 |
| 7,137,171 | B2 | 11/2006 | Meech et al. | |

* cited by examiner

*Primary Examiner* — Korie H. Chan
(74) *Attorney, Agent, or Firm* — Summa, Additon & Ashe, P.A.

(57) ABSTRACT

The invention relates to a traverse rod assembly for supporting a window covering. The traverse rod assembly includes a decorative arcuate member defining a channel at one end. A carrier tab is affixed within the channel, thereby maintaining the substantially vertical alignment of the decorative arcuate member even when the window covering is manipulated. By retaining a substantially vertical alignment, the decorative arcuate members more closely resemble the appearance of a traditional curtain rod, and they avoid potentially damaging contact with other decorative features of the traverse rod assembly.

11 Claims, 3 Drawing Sheets

TRAVERSE ROD ASSEMBLY

CROSS-REFERENCE TO PRIORITY APPLICATION

This application hereby claims the benefit of and incorporates entirely by reference commonly assigned U.S. Provisional Application Ser. No. 61/243,412, for Traverse Rod Assembly, filed Sep. 17, 2009.

FIELD OF THE INVENTION

The invention relates to drapery rods, and more particularly to an improved traverse rod assembly.

BACKGROUND OF THE INVENTION

Traverse rods typically are designed to support a window covering (i.e., a curtain, drapes, a wall covering, a screen, blinds), and to facilitate the manipulation of the window covering across a span (e.g., drawing a curtain closed to cover a window). Such traverse rods may employ various design features principally intended to enhance their aesthetic appearance. Typically, these design features include a means of giving the traverse rod the appearance of a traditional curtain rod. Typical examples of these aesthetic design features include decorative members that substantially hide the traverse track (e.g., a fascia that looks like a rod when viewed from the front), decorative rings, decorative arcuate members (i.e., partial rings) and decorative finials.

To give the appearance of traditional curtain rings while allowing the window covering to be manipulated over substantially the entire span of the traverse rod (i.e., to avoid the rings being blocked by the mounting assembly of the traverse rod), it is known to employ decorative arcuate members (i.e., partial rings). Because they do not encircle the entire traverse rod, these decorative arcuate members can move past the intersection of the traverse rod and its mounting assembly (i.e., supports, mounting brackets).

It is desirable for these decorative arcuate members to mimic as closely as possible the appearance of traditional curtain rings. A disadvantage of existing traverse rods is that the manipulation of the window covering typically causes the decorative arcuate members to become positioned in a non-uniform manner (i.e, some decorative arcuate members partially rotated in one direction, others in another direction, and still others not rotated at all). This non-uniform appearance is typically not aesthetically desirable and inhibits efforts to give the appearance of a traditional curtain rod.

A further disadvantage of existing traverse rods is that the manipulation of the window covering means typically causes the decorative arcuate members to make contact with other decorative design features of the traverse rod (e.g., the decorative fascia). Over time, such contact can potentially affect the aesthetic appearance of the decorative arcuate members and/or the other decorative design features (e.g., by scratching the wood fascia).

Accordingly, there exists a need for a traverse rod assembly with decorative arcuate members that can maintain a substantially uniform appearance and that can substantially avoid contact with other decorative features of the traverse rod assembly.

SUMMARY OF THE INVENTION

It is an object of the present invention to provide a traverse rod assembly that features decorative arcuate members which maintain a substantially uniform orientation during and after manipulation of the window covering.

It is a further object of the present invention to provide a traverse rod assembly that features decorative arcuate members which substantially avoid contact with the other decorative features of the traverse rod assembly, thereby maintaining the desired aesthetic appearance of the traverse rod assembly.

It is yet a further object of the present invention to provide a traverse rod assembly that features decorative arcuate members that can be replaced without the need for removing any moveable carriers from the traverse track.

It is yet a further object of the present invention to provide a traverse rod assembly that features removable decorative arcuate members which maintain a substantially uniform orientation during and after manipulation of the window covering.

It is yet a further object of the present invention to provide a traverse rod assembly that features removable decorative arcuate members which substantially avoid contact with other decorative features of the traverse rod assembly, thereby maintaining the desired aesthetic appearance of the traverse rod assembly.

In a preferred embodiment, a traverse rod assembly according to the present invention comprises a longitudinally extending traverse track having a longitudinally extending carrier slot; at least one movable carrier comprising a first section moveably disposed within the traverse track suitable for allowing the moveable carrier to be moveably mounted to the traverse track and a second section extending from the first section through the carrier slot; at least one carrier tab having an aperture for supporting a window covering, the carrier tab being demountably engaged to the second section of the moveable carrier; and at least one decorative arcuate member being fixably attached to said carrier tab.

In an alternative embodiment, a traverse rod assembly according to the present invention comprises a longitudinally extending traverse track defining a longitudinally extending carrier slot; at least one moveable carrier comprising a first section moveably disposed within the traverse track suitable for allowing the moveable carrier to be moveably mounted to the traverse track and a second section extending from the first section through the carrier slot; at least four rollers suitable for facilitating the movement of the moveable carrier longitudinally along said traverse track, the rollers being rotatably fixed to the moveable carrier's first section and symmetrically positioned in equal numbers on opposite sides of the latitudinal axis of the moveable carrier in a manner sufficient to substantially prevent the moveable carrier from becoming angularly displaced; at least one carrier tab having an aperture for supporting a window covering, the carrier tab being demountably engaged to the second section of the moveable carrier; a longitudinally extending decorative fascia attached to the traverse track; at least one decorative arcuate member having a first end and a second end, which decorative arcuate member is attached to the carrier tab; a member suitable for facilitating the opening and closing of the window covering and attached to a moveable carrier; a mounting assembly attached to the traverse track; and a channel defined by the first end of the decorative arcuate member.

Further features, objects and advantages of the present invention will become apparent from the following detailed description and the accompanying drawings.

DETAILED DESCRIPTION

As described above, the present invention embraces a traverse rod assembly that is designed to provide an aesthetically desirable appearance, and that is designed to minimize wear damage to decorative features of the traverse rod assembly.

The preferred embodiments of the present invention and its advantages are best understood by referring now in more detail to FIGS. 1 through 5 of the drawings, in which like numerals refer to like parts.

Figure 1:
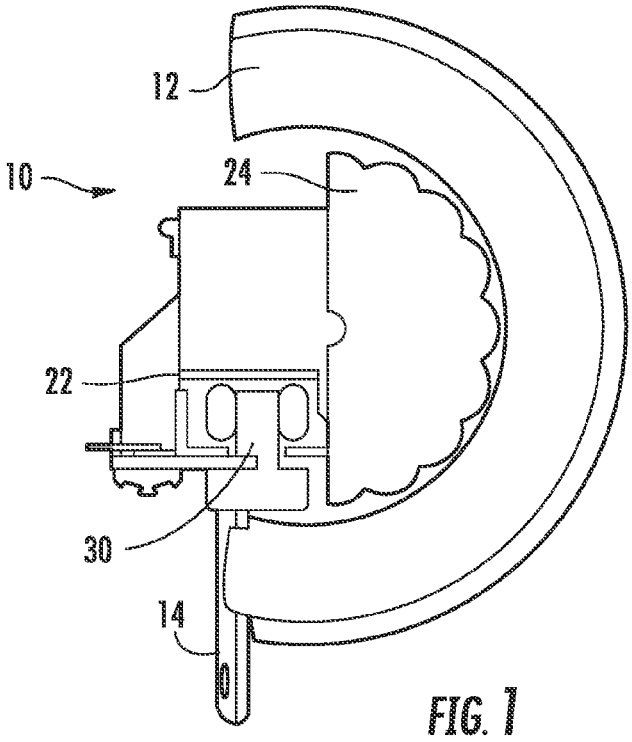
FIG. 1 depicts a cross-section view of an exemplary traverse rod assembly.

FIG. 1 is a cross-section view of the traverse rod assembly 10 illustrating a decorative arcuate member 12, a carrier tab 14, a moveable carrier 30, a traverse track 22 and a longitudinally extending decorative fascia 24.

The traverse track 22 may be made of a metal, such as steel or other suitable material. The traverse track 22 extends longitudinally, and defines an opening (i.e., a carrier slot) extending longitudinally along substantially the entire length of the traverse track 22.

The moveable carrier 30 comprises a first section 32 moveably disposed within the traverse track 22. The moveable carrier's first section 32 is of greater width than the carrier slot of the traverse track 22, thereby causing said moveable carrier 30 to be moveably mounted within said traverse track 22. A second section 34 of said moveable carrier 30 extends from said first section 32 through the carrier slot of the traverse track 22.

A carrier tab 14 is demountably engaged to the second section 34 of the moveable carrier 30. The carrier tab 14 defines an aperture 16 for receiving a supporting member (e.g. hooks, rope) of the window covering. Typically, hooks are attached to the window covering, and these hooks are passed through the aperture 16 defined by the carrier tab 14 to support the window covering.

A decorative arcuate member 12 having a first end and a second end is fixably attached (e.g., by inserting a screw through an aperture in the carrier tab 14 and into the decorative arcuate member 12) to the carrier tab 14. In a preferred embodiment, the decorative arcuate member 12 is approximately half of a traditional ring, thereby giving the appearance of a complete ring when viewed from the front. The surface of the first end of the decorative arcuate member 12 defines a channel (i.e., a groove) extending substantially vertically through substantially the entire length of the surface of the first end of the decorative arcuate member 12. Typically, the horizontal width of this channel is large enough to receive the carrier tab 14 in a vertical orientation, but small enough to prevent the rotation of the decorative arcuate member 12 relative to the carrier tab 14. In other words, when the carrier tab 14 is fixably attached to the decorative arcuate member, the carrier tab's 14 left and right sides will be adjacent to, and flush with, the protruding portions forming the channel in the first end of the decorative arcuate member 12.

By preventing the rotation of the decorative arcuate member 12 relative to the carrier tab 12, the decorative arcuate member 12 is fixed in a generally vertical position. This generally vertical positioning provides the desired aesthetic appearance of the decorative arcuate member 12 (i.e., it gives the appearance of curtain rings with the same vertical alignment that would result from bearing the weight of the window covering). Further, this generally vertical positioning substantially reduces contact between the decorative arcuate member 12 and other decorative features of the traverse rod assembly 10 (e.g., the longitudinally extending decorative fascia).

In other words, it is the positioning of the carrier tab 14 within the channel defined by the first end of the decorative arcuate member 12 that allows the traverse rod assembly 10 according to the present invention to overcome the shortcomings of earlier designs. In particular, a design providing that a carrier tab be affixed to an end of a decorative arcuate member with no channel would allow for the rotation of the decorative arcuate member relative to the carrier tab. More specifically, although the carrier tab and decorative arcuate member may be fixably attached (e.g., by a screw), the relative rotational movement of these two members may not be prevented without the channel feature of the present invention. In particular, the application of force to the carrier tab over time (e.g., by manipulating the window covering) can loosen the means of attaching the carrier tab to the decorative arcuate member (e.g., the screw securing the carrier tab to the decorative arcuate member becomes loosened). Because the traverse rod assembly 10 according to the present invention prevents rotational movement of the carrier tab 14 relative to the decorative arcuate member 12, this problem of a loosening of the means of connecting these two members is alleviated; and the decorative arcuate member 12 therefore remains substantially securely fixably attached to the carrier tab 14 in a substantially vertical alignment.

The window covering is opened and closed by moving the moveable carrier 30 longitudinally along the traverse track 22. In a preferred embodiment, the traverse rod assembly 10 according to the present invention incorporates a means for moving each moveable carrier 30 along the traverse track 22. Such means of moving each moveable carrier 30 are well known to a person of ordinary skill in the art. For example, a cord may be run through a pulley and attached to at least one master carrier 17. When the cord is pulled the master carrier 17 moves horizontally along the traverse track 22. Because the master carrier 17 is attached to the window covering, the window covering and all of the moveable carriers attached thereto are also pulled in the direction of the master carrier 17. This use of a master carrier is well known in the art.

In a preferred embodiment of the traverse rod assembly according to the present invention, a member (e.g., a baton, a cord) suitable for facilitating the opening of closing of the window covering is attached to at least one of the moveable carriers. For example, a baton may be used to move the moveable carriers 14 along the traverse track 22. A baton is typically a stick-like object connected at one end to a master carrier 17. The baton is grasped and pulled or pushed in a manner that causes the master carrier 17 to pull or push the moveable carriers 30, thereby opening or closing the attached window covering. The use of a baton is well known in the art.

In a preferred embodiment, the traverse rod assembly 10 according to the present invention is mounted to a supporting surface (e.g., a wall, a ceiling, a window frame) by a mounting assembly. Such mounting assemblies are known in the art. For example, a mounting bracket may be fixably attached at a first end to the mounting service (e.g., by screwing it to the supporting surface). At a second end, the bracket may be fixably or removably attached to the traverse rod assembly 10.

To give the traverse rod assembly 10 the appearance of a traditional curtain rod, a longitudinally extending decorative fascia 24 is fixably attached to the traverse track 22. Typically, the longitudinally extending decorative fascia 24 comprises a semi-cylindrical member. Typically, the longitudinally extending decorative fascia 24 is of sufficient length to substantially cover the front of the traverse track 22, thereby hiding the traverse track 22 when viewed from the front. The longitudinally extending decorative fascia 24 may be comprised of various materials. Typically, the longitudinally extending decorative fascia 24 is comprised of wood, metal or resin; but it can be comprised of any substantially rigid material (e.g., glass, stone).

Figure 2:
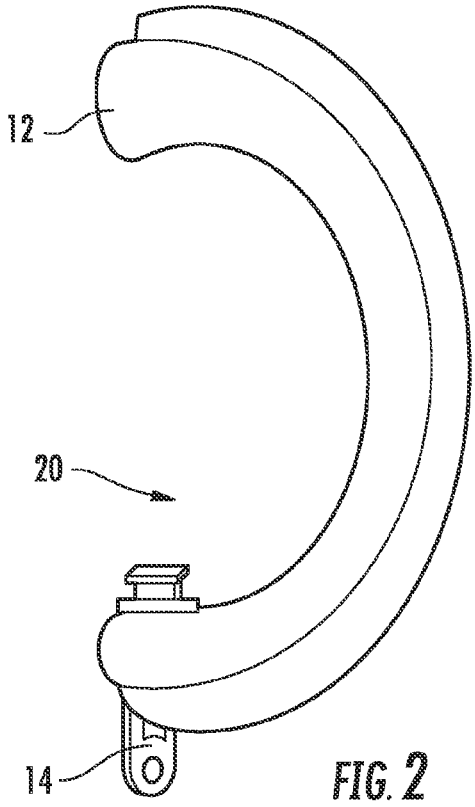
FIG. 2 depicts a perspective view of an exemplary decorative arcuate member fixably attached to an exemplary carrier tab.

FIG. 2 is a perspective view of an exemplary decorative arcuate member-carrier tab assembly 20. The carrier tab 14 is fixably attached within the channel defined by a first end of an exemplary decorative arcuate member 12. Typically, the decorative arcuate member 12 is made of wood, metal or resin, but it can be comprised of any substantially rigid material (e.g., glass, stone). Other traverse rod assemblies have the decorative arcuate member being integral with the moveable carrier. An advantage of the traverse rod assembly 10 of the present invention is that any type of decorative arcuate member 12 (e.g., wood, plastic or metal) may be fixably attached to the carrier tab 14 (e.g., by screwing the two members together). This simplifies the manufacturing process because the moveable carriers 30 and carrier tabs 14 are consistent across all models, and only the decorative arcuate members 12 need be changed.

Furthermore, if a decorative arcuate member 12 is damaged, only that damaged decorative arcuate member 12 need be removed in order to be replaced. Because other types of traverse rod assemblies require the removal of the entire decorative arcuate member-moveable carrier assembly to replace a damaged decorative arcuate member, these other assemblies require that many or all of the moveable carriers be removed to access the damaged decorative arcuate member. This process is highly inefficient, time-consuming, and undesirable. The traverse rod assembly 10 according to the present invention greatly simplifies the repair and replace process.

Figure 3:
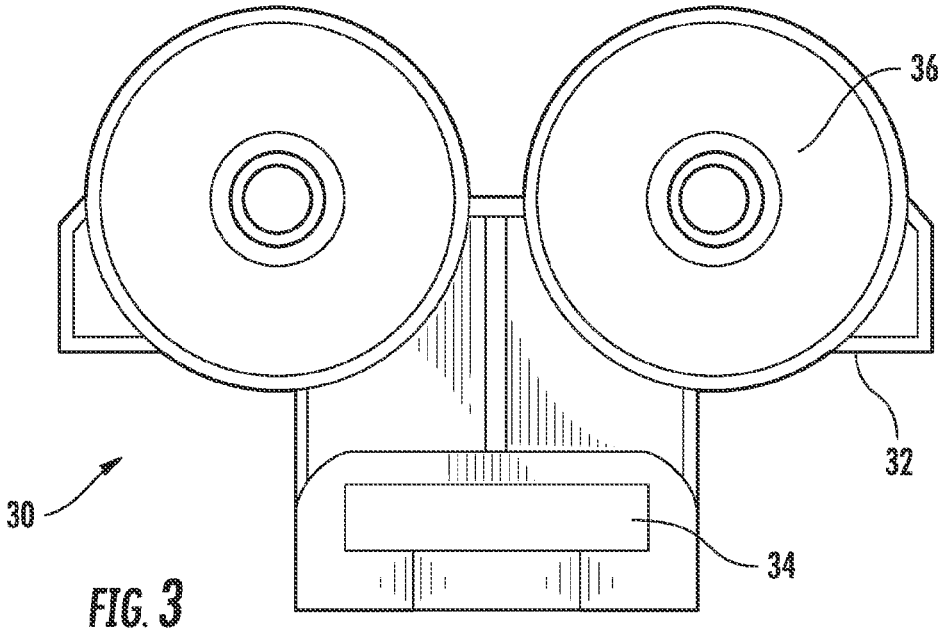
FIG. 3 depicts a front elevation view of an exemplary movable carrier.

FIG. 3 is a front view of an exemplary moveable carrier 30 according to the present invention. The first section 32 of the moveable carrier 30 is wider than the second section 34. The first section 32 is moveably disposed within the traverse track 22. Typically, rollers 36 are rotatably attached to the first section 32 of the moveable carrier 30 to allow for the moveable carrier 30 to roll longitudinally along the traverse track 22. Typically, the rollers 36 are rotatably attached to the movable carrier 32 in pairs. In the exemplary moveable carrier 30 depicted in FIG. 3, two pairs of rollers 36 are rotatably attached to the first section 32 of the moveable carrier 30. Having two pairs of rollers 36, each pair positioned symmetrically on opposite sides of the latitudinal axis of the moveable carrier 30, substantially prevents the moveable carrier 30 from becoming angularly displaced (i.e., rocking) from its substantially vertical alignment. Preventing the angular displacement of the moveable carrier 30 is desirable because it also maintains the vertical alignment of the carrier tab 14 and decorative arcuate member 12 assembly.

The second section 34 of the moveable carrier 30 passes through the carrier slot of the traverse track 22. Typically, the second section 34 of the moveable carrier 30 is configured in a manner that allows the moveable carrier 30 to be detachably fixed to the carrier tab 14. As shown in FIG. 3, the second section 34 defines a slot into which one end of the carrier tab may be removably positioned.

Figure 4:
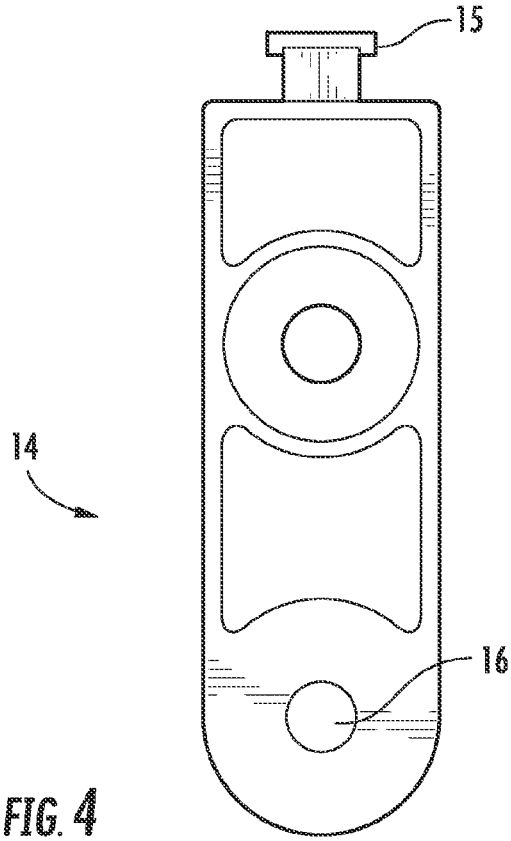
FIG. 4 depicts a front elevation view of an exemplary carrier tab.
Figure 5:
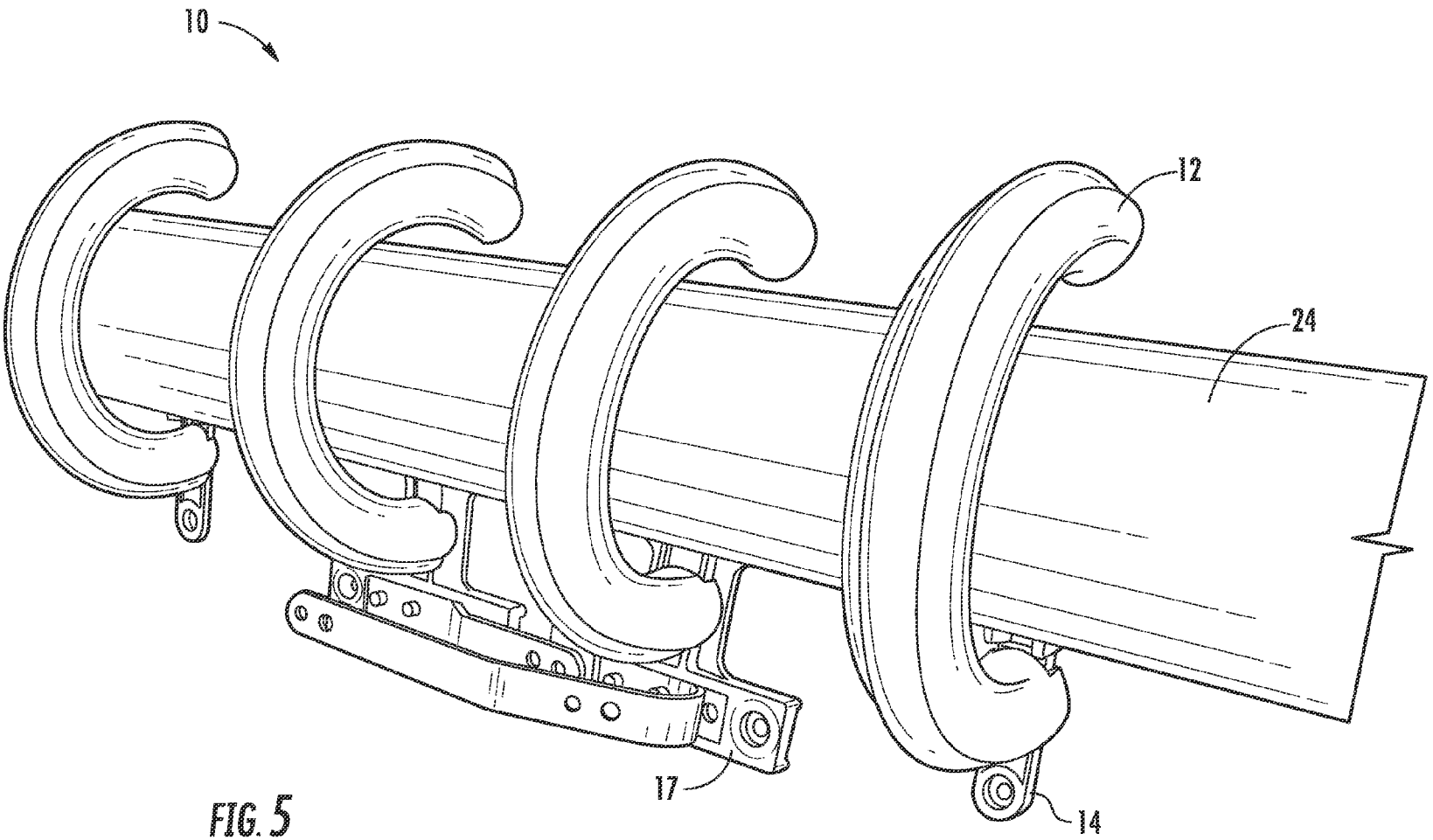
FIG. 5 depicts a perspective view of an exemplary traverse rod assembly.

FIG. 4 depicts a front elevation view of an exemplary carrier tab 14. Typically, the carrier tab 14 has at one end a means of demountably engaging the moveable carrier 30. For example, one end of the carrier tab 14 may define a connector 15. The connector 15 is shaped to fit within the slot defined by the second section 34 of the moveable carrier 30. In this way, the carrier tab 14 is demountably attached to the moveable carrier 30.

As depicted in FIG. 4, the carrier tab further defines an aperture 16 for supporting the window covering. Typically, the supporting hook for the window covering is passed through this aperture 16, thereby hanging the window covering from the carrier tab 14 and allowing it to be manipulated as the moveable carrier 30 is manipulated.

The invention claimed is:

1. A traverse rod assembly for supporting a window covering comprising:

a longitudinally extending traverse track defining a longitudinally extending carrier slot;

at least one moveable carrier comprising a first section moveably disposed within said traverse track suitable for allowing said moveable carrier to be moveably mounted to said traverse track and a second section extending from said first section through said carrier slot;

at least one carrier tab having an aperture for supporting a window covering, said carrier tab being demountably engaged to said second section of said moveable carrier;

at least one decorative arcuate member having a first end and a second end, wherein said decorative arcuate member is fixable attached to said carrier tab; and a channel defined by said first end of said decorative arcuate member;

wherein at least a portion of said carrier tab is seated within said channel in a manner sufficient to substantially prevent the rotation of said carrier tab about the longitudinal axis of said first end of said decorative arcuate member; and wherein said carrier tab is fixably attached to said first end of said decorative arcuate member.

2. The traverse rod assembly according to claim 1, wherein said channel spans substantially the entire length of said first end of said decorative arcuate member.

3. The traverse rod assembly according to claim 1, further comprising a roller suitable for facilitating the movement of said moveable carrier longitudinally along said traverse track, said roller being rotatably fixed to said moveable carrier's first section.

4. The traverse rod assembly according to claim 1, further comprising a plurality of rollers suitable for facilitating the movement of said moveable carrier longitudinally along said traverse track, said rollers being rotatably fixed to said moveable carrier's first section.

5. The traverse rod assembly according to claim 1, further comprising at least four rollers suitable for facilitating the movement of said moveable carrier longitudinally along said traverse track, said rollers being rotatably fixed to said moveable carrier's first section and said rollers being symmetrically positioned in equal numbers on opposite sides of the latitudinal axis of said moveable carrier in a manner sufficient to substantially prevent said moveable carrier from becoming angularly displaced.

6. The traverse rod assembly according to claim 1, further comprising a longitudinally extending decorative fascia fixably attached to said traverse track and substantially covering the front of said traverse track.

7. The traverse rod assembly according to claim 6, wherein said longitudinally extending decorative fascia is substantially comprised of a material selected from the group consisting of resin, metal, wood, glass and stone.

8. The traverse rod assembly according to claim 6, wherein said decorative arcuate member is substantially comprised of a material selected from the group consisting of resin, metal, wood, glass and stone.

9. A traverse rod assembly for supporting a window covering comprising:

a longitudinally extending traverse track defining a longitudinally extending carrier slot;

at least one moveable carrier comprising a first section moveably disposed within said traverse track suitable for allowing said moveable carrier to be moveably mounted to said traverse track and a second section extending from said first section through said carrier slot;

at least four rollers suitable for facilitating the movement of said moveable carrier longitudinally along said traverse track, said rollers being rotatably fixed to said moveable carrier's first section and said rollers being symmetrically positioned in equal numbers on opposite sides of the latitudinal axis of said moveable carrier in a manner sufficient to substantially prevent said moveable carrier from becoming angularly displaced;

at least one carrier tab having an aperture for supporting a window covering, said carrier tab being demountably engaged to said second section of said moveable carrier;

a longitudinally extending decorative fascia, wherein said longitudinally extending decorative fascia is attached to said traverse track;

at least one decorative arcuate member having a first end and a second end, wherein said decorative arcuate member is fixably attached to said carrier tab;

a member suitable for facilitating the opening and closing of said window covering, said member being attached to at least one of said moveable carriers;

a mounting assembly suitable for attaching said traverse rod assembly to a supporting surface, said mounting assembly being attached to said traverse track; and a channel defined by said first end of said decorative arcuate member;

wherein at least a portion of said carrier tab is seated within said channel in a manner sufficient to maintain the substantially vertical orientation of said decorative arcuate member; and wherein said carrier tab is fixably attached to said first end of said decorative arcuate member.

10. The traverse rod assembly according to claim 9, wherein said longitudinally extending decorative fascia is substantially comprised of a material selected from the group consisting of resin, metal, wood, glass and stone.

11. The traverse rod assembly according to claim 9, wherein said decorative arcuate member is substantially comprised of a material selected from the group consisting of resin, metal, wood, glass and stone.

* * * * *

UNITED STATES PATENT AND TRADEMARK OFFICE

CERTIFICATE OF CORRECTION

PATENT NO. : 8,240,489 B2
APPLICATION NO. : 12/885057
DATED : August 14, 2012
INVENTOR(S) : Randy McCormack It is certified that error appears in the above-identified patent and that said Letters Patent is hereby corrected as shown below:

In the Claims

Claim 1, Column 6, Line 32 reads "ber is ~~fixable~~ attached to said carrier tab; and" and should read "ber is fixably attached to said carrier tab; and"

Signed and Sealed this
Second Day of October, 2012

David J. Kappos

David J. Kappos
*Director of the United States Patent and Trademark Office*